US005401024A

United States Patent [19]

Simunek

[11] Patent Number: 5,401,024

[45] Date of Patent: Mar. 28, 1995

[54] KENO TYPE VIDEO GAMING DEVICE

[75] Inventor: Paul Simunek, Chicago, Ill.

[73] Assignee: WMS Gaming Inc., Chicago, Ill.

[21] Appl. No.: 214,396

[22] Filed: May 9, 1994

[51] Int. Cl.[6] ..... A63F 9/22; G07F 17/34

[52] U.S. Cl. ..... 273/138 A; 273/269

[58] Field of Search ..... 273/433, 434, 85 G, 273/85 CP, 269, 138 R, 138 A

[56] References Cited

U.S. PATENT DOCUMENTS

| | | | |
|---|---|---|---|
| 4,254,404 | 3/1981 | White | 273/138 A |
| 4,856,787 | 8/1989 | Itkis | 273/269 |
| 5,192,076 | 3/1993 | Komori | 273/138 A |
| 5,259,616 | 11/1993 | Bergmann | 273/138 A |
| 5,326,104 | 7/1994 | Pease et al. | 273/138 A |

FOREIGN PATENT DOCUMENTS

| | | | |
|---|---|---|---|
| 4201534 | 7/1993 | Germany | 273/138 A |

*Primary Examiner*—Jessica Harrison

*Attorney, Agent, or Firm*—Rockey, Rifkin and Ryther

[57] ABSTRACT

A keno type amusement device utilizes a microprocessor based video display system. One or more of the matched spots are replaced on the display with slot machine like "reel" displays. Each reel contains a plurality of different characters. The reels are spun and a character set is randomly generated. A bonus payout is based on the outcome of the randomly generated character set.

6 Claims, 5 Drawing Sheets

KENO TYPE VIDEO GAMING DEVICE

BACKGROUND AND SUMMARY OF THE INVENTION

The present invention generally relates to video games and, more particularly, to video keno games. In the art of video gambling machines, video keno games are played by player interaction with a keno board displayed on a monitor, the board typically having 80 consecutively numbered spots. The game, including the board, is simulated in software which is executed by an internal microprocessor.

A description of the play of a typical keno game is as follows. First, the player places a bet and selects up to ten numbered "spots" on the board. Then, the game microprocessor randomly selects 20 spots on the board and determines the number of matches between the player selected spots and the randomly selected spots. The number of matches is compared to a pay table stored in computer memory to determine the payout. The pay table contains predetermined payout levels for different numbers of matches. Thus, the goal of playing video keno is to obtain as many matches as possible to increase the size of the payout.

It is desirable for manufacturers of video keno games to provide new ways to increase the payout values. As payout levels increase, player interest in the game is fostered which leads to increased game revenue. The present invention satisfies this desire by increasing the payout levels of video keno games.

In a first embodiment of the invention, a player selects one spot designated as a "super spot" in addition to the other spots selected at the beginning of a game. If the super spot is matched, the keno game provides a bonus payout in addition to the basic or regular keno payout. The matched super spot on the displayed keno board is temporarily replaced with a slot-machine like "reel" which has a number of multiplier factors on it. The reel appears to spin to simulate the random selection of a payout multiplier factor. The system random number generator selects a multiplier and the reel then displays this value. The player is then paid the basic keno payout multiplied by the displayed factor.

In a second embodiment of the invention, the microprocessor system temporarily replaces each of the matched spots with a slot machine-like "reel" display having a plurality of characters thereon. The set of "reels" spin as in a video slot machine and, upon stopping display a randomly selected set of characters. The payout is calculated by comparing the selected characters to a pay table stored in computer memory. The player is then paid this amount.

DETAILED DESCRIPTION OF THE PREFERRED EMBODIMENT

Figure 1:
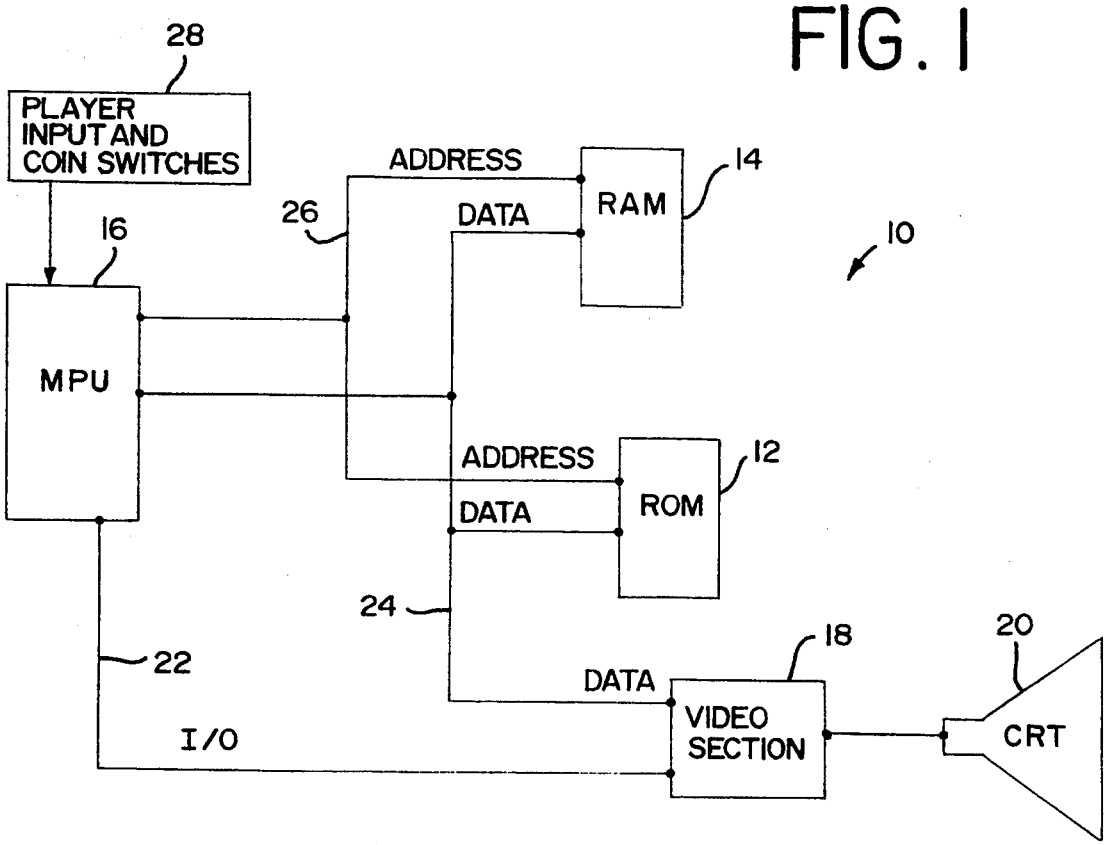
FIG. 1 is a schematic diagram of a hardware system suitable for use with the keno type gaming device according to the present invention.

Referring to FIG. 1, the hardware 10 suitable for use with the present invention is illustrated in schematic form.

Stored in read only memory (ROM) 12 is a computer program for playing keno type games as explained hereafter. Random access memory 14 is used to temporarily store information associated with the current play of the keno game while microprocessor unit (MPU) 16 executes the instructions stored in ROM 12. Video section 18 permits the processor to display video information relating to the game on CRT 20.

The video section 18 is connected to the microprocessor unit 16 by input/output lines 22 which provides the pathway for the MPU 16 to respond to the input commands of the game player from player input and coin switches 28. Additionally, the video section 18 is connected with the ROM 12, the RAM 14 and the MPU 16 through the data lines 24. The address line 26 operatively interconnects the RAM 14, the ROM 12 and the MPU 16 such that the game can be played.

Figure 3:
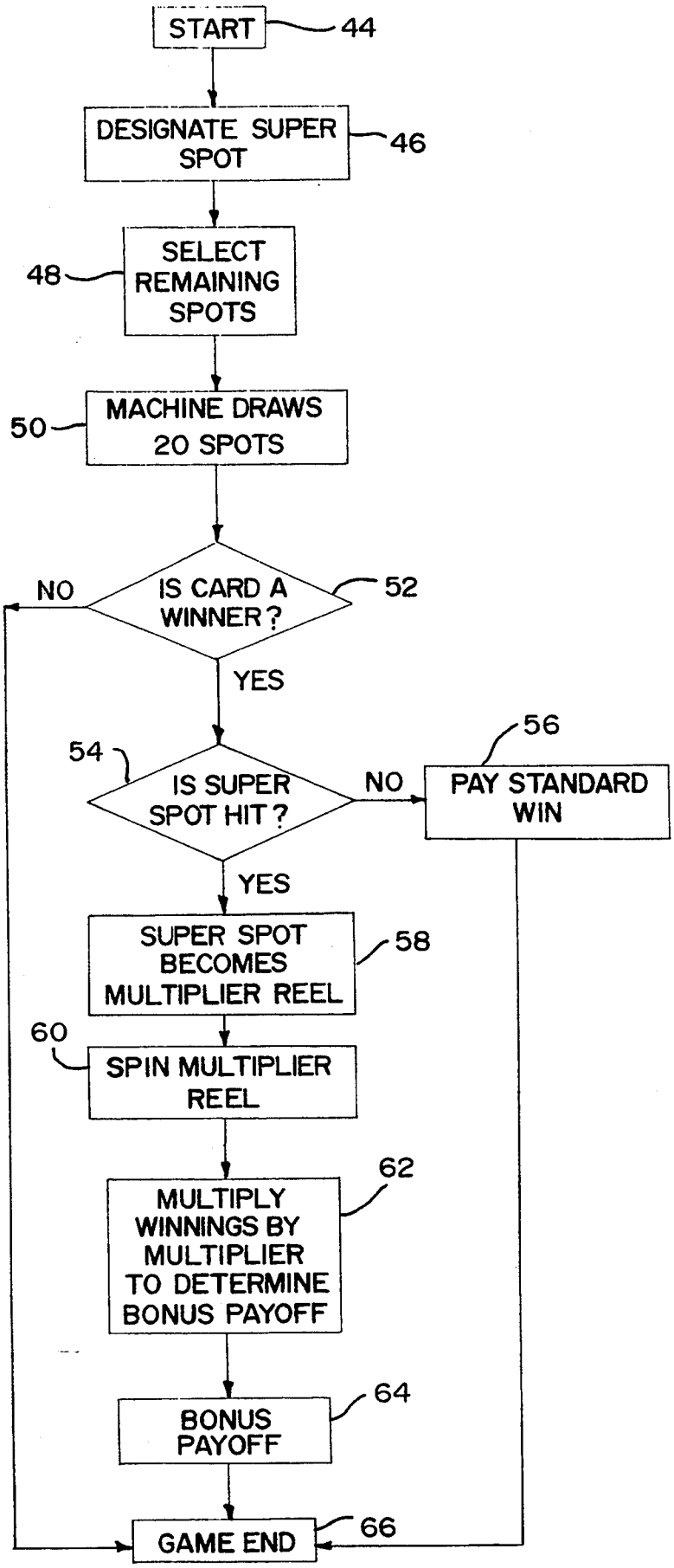
FIG. 3 is a computer flow diagram illustrating a first embodiment of the invention.
Figure 5:
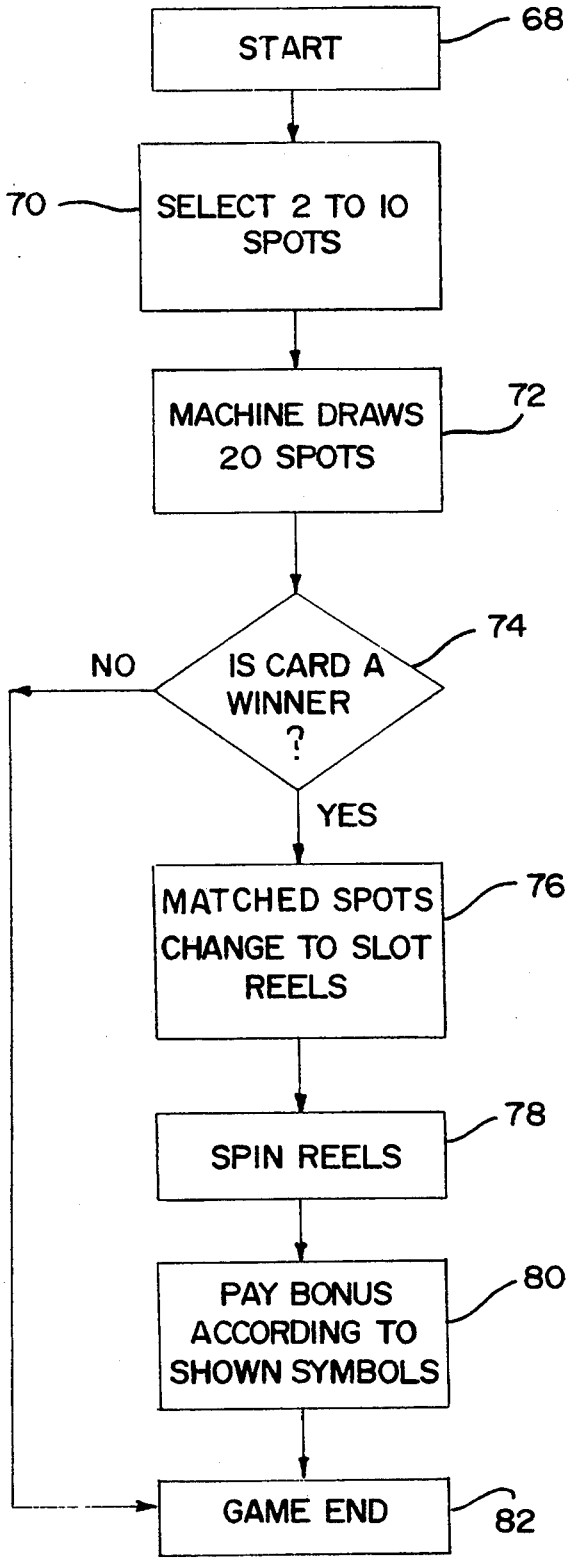
FIG. 5 is a computer flow diagram which illustrates a second embodiment of the invention.

FIGS. 3 and 5 indicate the program steps necessary to practice the invention. It will be understood by those skilled in this art, that different hardware systems will use different computer code. The flow diagrams of FIGS. 3 and 5, however, permit the programming of the present invention on any system desired.

Figure 2:
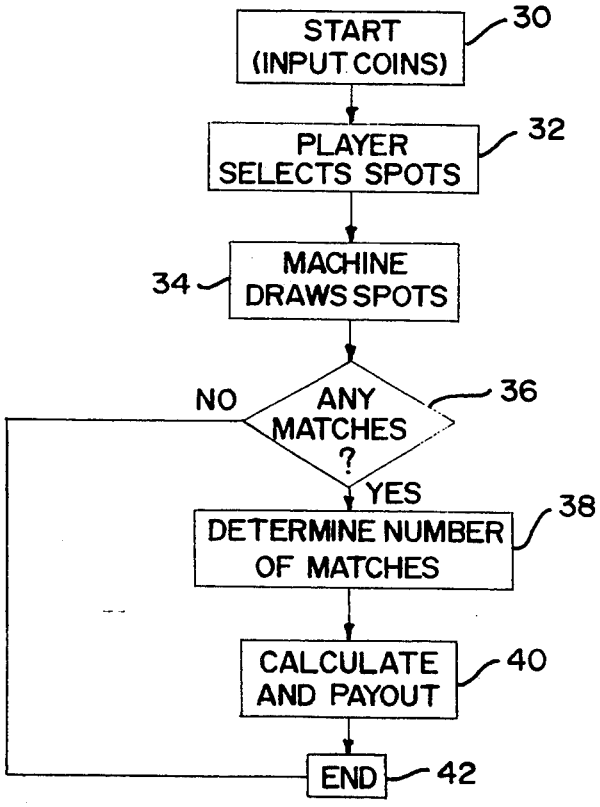
FIG. 2 is a computer flow diagram illustrating a prior art keno game.

Referring to FIG. 2, the program steps necessary for playing prior art video keno are illustrated. After start 30, the player selects a number of spots to be "marked" on the game board which is simulated in software and displayed on CRT 20 in step 32. The hardware, using a random number generator algorithm, selects a number of spots, typically 20, (step 34). It is determined at step 36 whether there are any matches between the machine selected spots and the player selected spots. If there are no matches, then the program ends at 42. The probability of matches occurring between the player selected spots and the randomly generated spots are fixed in prior art keno.

If there are matches, the number of matches is determined in step 38. The various payout amounts for different numbers of matches is stored in a pay table in ROM 12. The program calculates and pays the appropriate amount by comparing the number of matches to the pay table in step 40. An example of a partial keno pay table which contains payout levels for up to four matched spots is illustrated below.

| Four Spots Selected<br>Number of Matched Spots | Payout Units |
|---|---|
| One | 1 |
| Two | 2 |
| Three | 6 |
| Four | 72 |

For example, if the player matches four spots, then the player is compensated 72 units.

Figure 4:
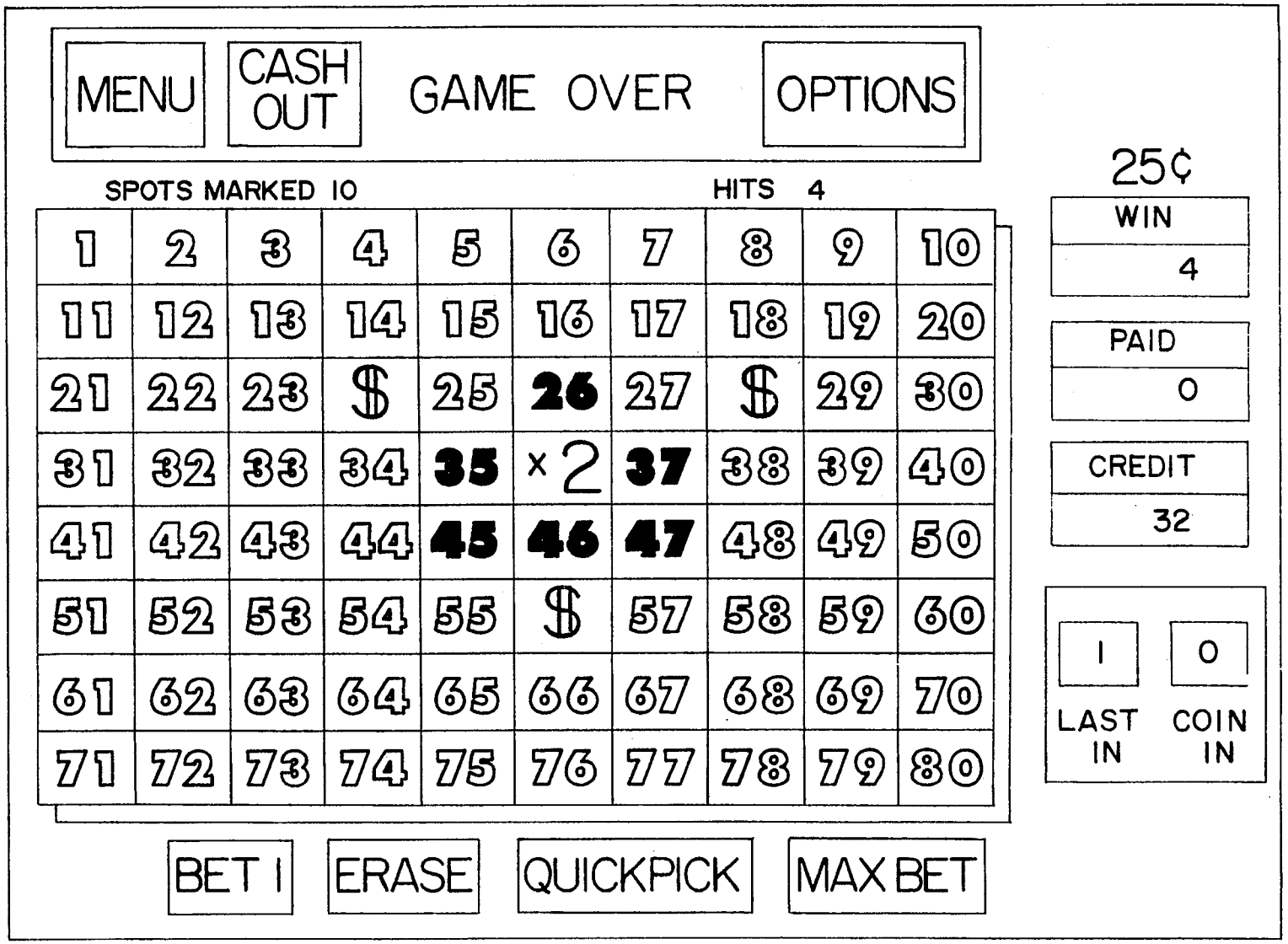
FIG. 4 is a simulated view of a display showing a randomly generated multiplier factor and the matched spots according to the first embodiment of the invention.
Figure 6:
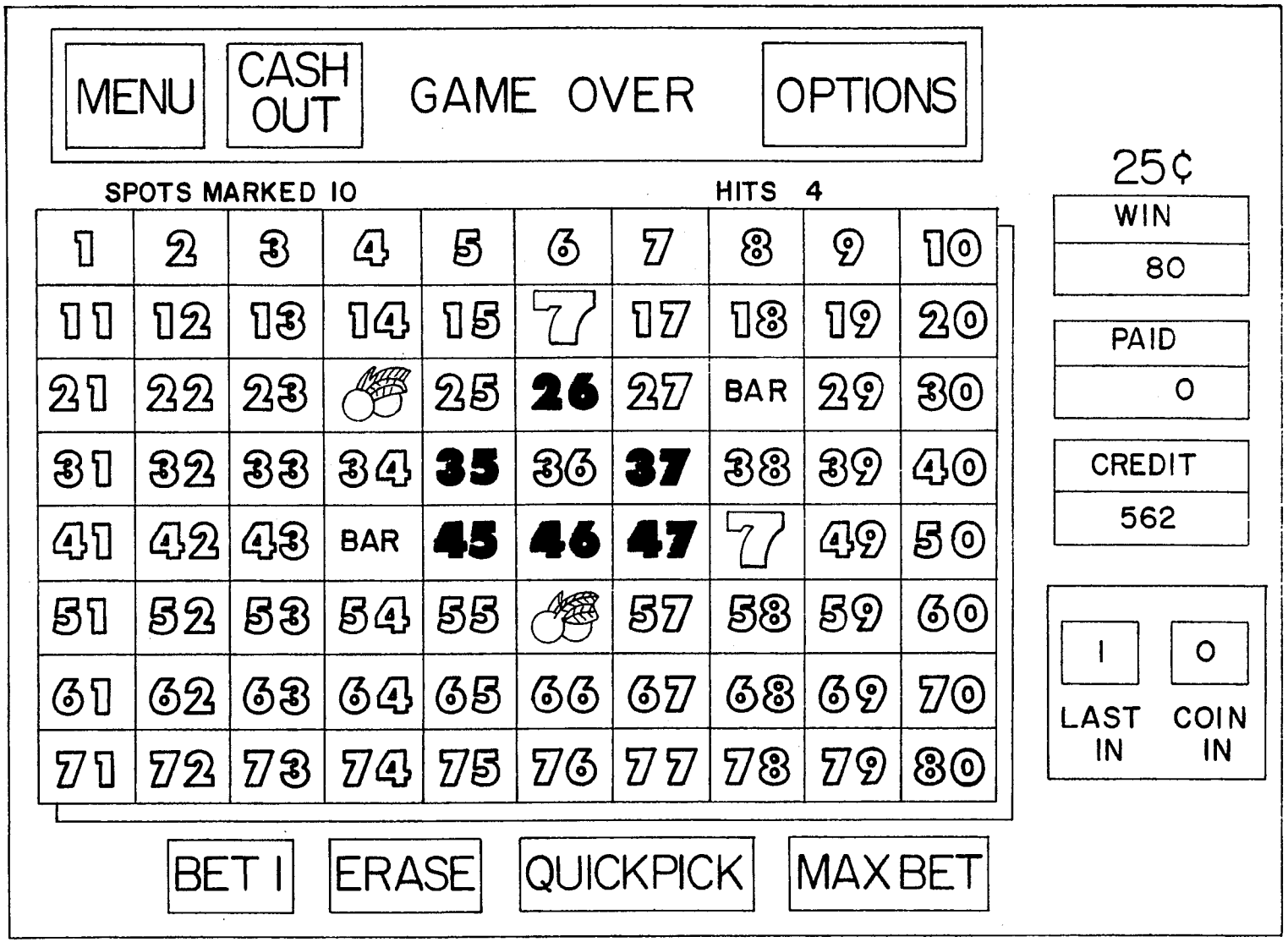
FIG. 6 illustrates a display useful in explaining the second embodiment of the invention.

FIGS. 3 and 5 illustrate two embodiments of the invention which provide increased payout levels based on the number of spots matched. Generally, the microprocessor system replaces from one up to all of the matched spots with video slot machine like "reel" displays as shown in FIGS. 4 and 6, each reel having a plurality of characters displayed thereon. The reels are spun and then stopped to randomly determine a bonus payout.

FIGS. 3 and 4 illustrate the steps involved in a first embodiment of the invention. In this embodiment, a bonus payout is made when a player selected "super spot" is matched by one of the randomly generated spots. Play begins with the player designating the super spot and selecting the remaining spots in steps 46 and 48. The machine then randomly generates a set of spots, usually 20 (step 50).

In step 52, matches are determined. If there are no matches, then the game ends. If there are matches, it is determined at step 54 whether the player's designated super spot has been hit. If not, the player is paid the basic keno payout in step 56, (see steps 38 and 40 of FIG. 2). After payment is made, the game ends.

If the super spot is hit, the microprocessor system replaces the number display with a simulation of a slot machine type reel on CRT 20 in step 58 (see FIG. 4). The multiplier reel "spins" (step 60) to simulate the selection of a payout multiplier factor. In fact, the multiplier factor is randomly generated by the random number generator function of the computer and the display simply visually communicates the selection to the player. The selected multiplier (i.e., ×2) is used to increase the basic keno payout (step 62), which is paid to the player (step 63).

For example, if the basic payout is 100 units and the randomly generated multiplier is 3, then the player is paid a total of 300 units (step 63). Alternatively, the player can be paid the basic keno payout before the multiplier reel is spun with the excess, up to the multiplied basic payout, being paid at step 63. The amount paid for a given number of matches and the number and probabilities of each multiplier occurring are selected to arrive at a desired payback percentage.

FIGS. 5 and 6 illustrate the program steps for a second embodiment of the invention. In this embodiment, all or most of the matched spots are replaced with rotating reels which, in combination, are spun and then function as a video slot machine. At steps 68 and 70 the player selects up to ten spots. MPU 16 then randomly generates 20 spots out of the possible 80 numbers on the keno board (step 72).

At step 74, it is determined if there are any matches between the player selected spots and machine selected spots. If there are matches, then some or all of the matched spots are changed to appear on the CRT as video slot machine reels (step 76). (See FIG. 6). The reels are "spun" (step 78) using video graphics display techniques well known in this art. A payout is calculated and paid to the player based on the slot symbols randomly selected by the MPU (step 80). Alternatively, the basic keno payout could be paid before the matches spots are changed to slot reels with a bonus payout based on symbol coincidence being paid after the reels are spun. The game ends in step 82.

The payout is determined by comparing the combinations of the characters after the reels have been spun to a pay table stored in ROM 12. The paytable contains predetermined payouts based on the occurrence of symbols obtained after the reels have been spun for each number of spots hit.

A typical payout table for use with this embodiment is listed below wherein each video reel contains three characters, namely a "7," a bar and a cherry. The player is paid a certain amount per character obtained after the reels are spun, the amount increasing for increasing numbers of matched spots.

| Four Spots Selected Number of Matched Spots | Payout Units Per Character | | |
|---|---|---|---|
| | "7" | Bar | Cherry |
| 1 | 0 | 0 | 0 |
| 2 | 3 | 2 | 0 |
| 3 | 15 | 5 | 1 |
| 4 | 50 | 25 | 10 |

For example, if there are four matched spots, then the basic keno payout would be 72 units (see the discussion with reference to FIG. 2). If, on the subsequent spin of the "reels," four "7s" have been obtained, the player is paid 200 units. Alternatively, the player can be paid the basic payout of 72 units and then a bonus payout of 200 units after the reels are spun for a total of 272 units. The probabilities and payouts for each character occurring are changed to arrive at a desired payback percentage to maximize game revenue.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of increasing payouts while maintaining a desired win percentage in a video keno game including a microprocessor for randomly selecting numbers, a video display for displaying a plurality of numbered spots and a read-only memory (ROM) containing a game program and a pay table containing payout values based on the number of spots matched, the method comprising the steps of:

(a) determining from said pay table a basic keno payout based on the number of selected spots matching the numbers randomly selected by said microprocessor;

(b) if the basic payout is greater than zero, replacing at least one of the matched spots on the display with a simulated reel for displaying one of a plurality of characters;

(c) simulating spinning of the reel on the display while randomly selecting one of said characters;

(d) displaying on the reel the selected character; and (e) paying the basic keno payout and a bonus payout based on the selected characters displayed.

2. The method of claim 1 wherein multiple video reels are displayed and the bonus payout is determined by the valuation of the selected characters in said paytable.

3. The method of claim 1 wherein only one reel is displayed and further comprising the step of permitting the player to select a numbered spot on the display which, if selected, will be replaced by said reel, and wherein said characters on said reel are multiplier factors, said bonus payout being determined by multiplying the basic keno payout by the selected multiplier factor.

4. A video keno gaming device providing increased payouts while maintaining a desired win percentage comprising:

(a) memory means for containing a game program and a paytable containing payout values;

(b) display means for displaying images to a game player;

(c) microprocessor means, responsive to said game program, for:

(1) initially displaying a plurality of numbered spots on the display means to permit the player to select a portion of said numbers, (2) generating randomly selected numbers, (3) determining from said pay table a basic payout based on the number of selected spots matching the numbers randomly selected by said microprocessor, (4) replacing at least one of the matched spots on the display with a simulated reel for displaying one of a plurality of characters if the basic payout is greater than zero, (5) simulating spinning of the reel on the display while randomly selecting one of said characters, (6) displaying on the reel the selected character, and (7) paying the basic keno payout and a bonus payout based on the selected characters displayed.

5. The device of claim 4 wherein said microprocessor means simulates multiple video reels and the bonus payout is determined by the valuation of the selected characters in said pay table.

6. The device of claim 4 wherein said microprocessor means simulates only one reel and further comprising means for permitting the player to select a numbered spot on said display means which, if selected, will be replaced by said reel, and wherein said characters on said reel are multiplier factors, said bonus payout being determined by multiplying the basic keno payout by the selected multiplier factor.

* * * * *